United States Patent [19]

Mosser

[11] Patent Number: 4,773,652

[45] Date of Patent: Sep. 27, 1988

[54] AUTOMATIC RESET TARGET ASSEMBLY

[76] Inventor: Kenneth J. Mosser, P.O. Box 242, Clarissa, Minn. 56440

[21] Appl. No.: 39,705

[22] Filed: Apr. 20, 1987

[51] Int. Cl.[4] ..... F41J 7/04

[52] U.S. Cl. ..... 273/392

[58] Field of Search ..... 273/390, 391, 392, 407

[56] References Cited

U.S. PATENT DOCUMENTS

| | | | |
|---|---|---|---|
| D. 287,614 | 1/1987 | Mosser . | |
| 996,712 | 7/1911 | Harper | 273/392 |
| 1,547,881 | 7/1925 | Lambert . | |
| 1,657,931 | 1/1928 | Krantz . | |
| 3,413,003 | 11/1968 | Bell . | |
| 3,814,429 | 6/1974 | Lienhard | 273/392 |
| 4,614,345 | 9/1986 | Doughty | 273/392 X |

FOREIGN PATENT DOCUMENTS

| | | | |
|---|---|---|---|
| 253785 | 11/1912 | Fed. Rep. of Germany | 273/392 |
| 285179 | 8/1952 | Switzerland . | |

OTHER PUBLICATIONS

American Rifleman publication, Jun. 1967.

Target Masters brochure, "Metallic Silhouette Target Shooting", Jan. 15, 1983.

*Primary Examiner*—Anton O. Oechsle

*Attorney, Agent, or Firm*—Burd, Bartz & Gutenkauf

[57] ABSTRACT

A target assembly comprising a target having a generally upright silhouette hinged to a base connected to a stake adapted to be anchored to the ground. A counterweight is attached to a downwardly extending arm adjacent the silhouette. The counterweight biases the silhouette in a generally upright position thereby the silhouette will move to a down position when hit with a projectile and automatically return to an upright position after the force of the projectile has been dissipated.

20 Claims, 1 Drawing Sheet

AUTOMATIC RESET TARGET ASSEMBLY

FIELD OF THE INVENTION

The invention is directed to automatic reset targets for projectiles. The target is a portable device having a silhouette held in a position so as to be hit with projectiles shot from firearms.

BACKGROUND OF INVENTION

Shooting, in general, has been popular since prehistoric days where there was rock throwing, spear tossing, and knife throwing. Today, silhouette shooting is enjoyed by many hobbyists and competitors. Targets for shooting practice are commonly used. These targets include clay discs and various cut-out figures or silhouettes, such as silhouette animals, beer cans or bottles, and human torsons. One target assembly comprises a cut-out silhouette rotatably mounted on a U-shaped frame anchored to a support or ground. A shaft extends downwardly from the center of the frame and is attached to the cut-out silhouette. The frame ends are inserted into the ground. When the silhouette is hit, it swings relative to the frame until stopped by gravitational forces. Another target has silhouettes mounted on a rubber shock-absorbing member which is secured to a grounded stake. The silhouette and rubber member bend rearwardly as they are hit by a projectile. The rubber member causes the silhouette to spring back to an upright position.

Prior target assemblies for shooting practice have had many difficulties. One major difficulty in resetting the silhouette to its original upright position when hit by a projectile. After being hit the silhouette continues to vibrate or to swing or are lying flat to the ground. There is a time lapse before the silhouette is fixed in an upright position. This makes the shooting of consecutive shots or rapid fire impractical and tie consuming.

SUMMARY OF THE INVENTION

The invention is directed to a target assembly that automatically returns to a selected position after being hit with a moving projectile, such as a bullet. The target assembly has a target attached to an anchor. A counterweight connected to the target is used to yieldably position a silhouette mounted on the target in a generally upright position. The target assembly is portable and can be set up in a relatively short period of time in an appropriate shooting area.

One form of the invention has a target that includes a base secured to a downwardly directed stake. The stake is adapted to penetrate into the ground to anchor the target in a fixed position. The movable member is part of a hinge means that is connected to the base. The movable member is pivotally mounted on the base for movement between a generally upright position and a generally horizontal position. A silhouette in the shape of a selected outline form, such as an animal, bird, person torso, or the like, is attached to the movable member. The movable member normally holds the silhouette in a generally upright position making it a visible target for the shooter. A plate connected to the movable member is used with a normally attached arm having a biasing counterweight to yieldably hold the silhouette in a generally upright position.

The target assembly automatically resets the silhouette in a generally upright position after the impact force of the projectile is dissipated. The entire target assembly is durable in construction and can take impacts from the bullets of al types of firearm handguns from BB to 45 caliber and larger firearms. After impact, the bullets deflect harmlessly upward. The target assembly is also useable in other types of target practice and competition, such as bow and arrow, cross bow, sling shot, golf, hand throwing or pitching of a ball. The above advantages and features of the target assembly are embodied in the following detailed description thereof.

DESCRIPTION OF A PREFERRED EMBODIMENT

Figure 1:
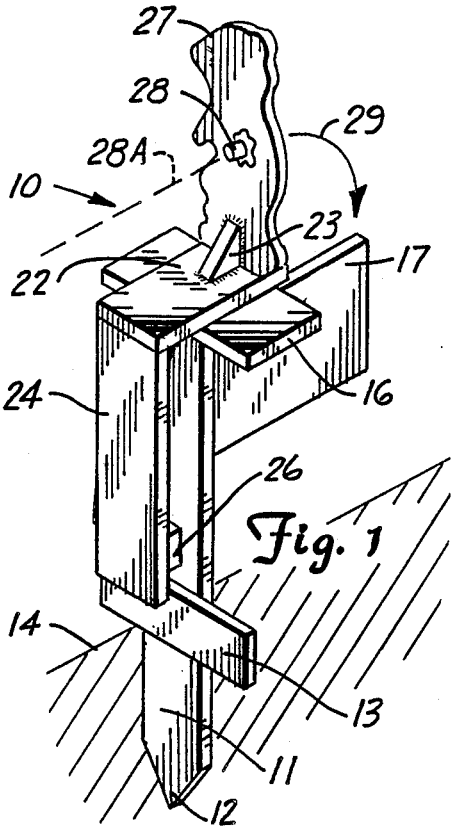
FIG. 1 is a perspective view of the target assembly of the invention anchored to the ground.
Figure 2:
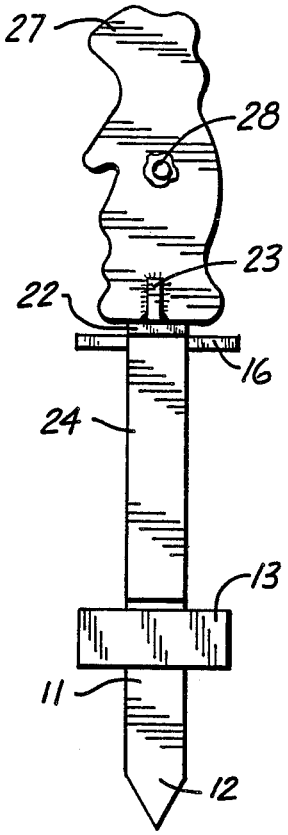
FIG. 2 is a front elevational view of the target of FIG. 1.
Figure 3:
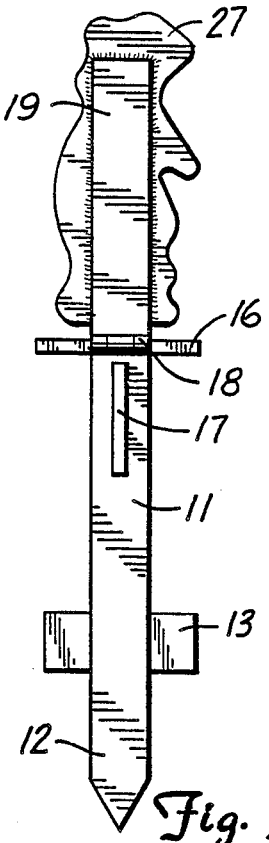
FIG. 3 is a rear elevational view of the target of FIG. 1.

Referring to FIG. 1, there is shown an automatic target reset assembly of the invention indicated generally at 10 used for firearm practice. Target assembly 10 also can be used for other sport activities including but not limited to bow and arrow, cross bow, sling shot, golf, hockey, and like projectile devices.

Target assembly 10 is fixed to the ground 14. Target assembly 10 can be attached to other supports. For example, when target assembly 10 is used indoors, a support, such as a platform or floor, is used to hold target assembly 10. A counterweight 26 on the target assembly 10 is used to continuously and yieldably hold a silhouette 27 in an upright position as seen in FIG. 1. When silhouette 27 is hit with a projectile 28, it swings backward against the biasing force of the counterweight 26. The counter weight 26 automatically resets silhouette 27 to its upright position.

Target assembly 10, as shown in FIGS. 1 to 5, has a generally upright stake 11 terminating in a lower pointed end 12. Stake 11 is a generally flat bar having a transverse bar 13 attached adjacent the pointed end 12. End 12 and bar 13 are normally inserted into the ground 14 to retain stake 11 in an upright position. A horizontal transverse base 16 is secured by welds or the like to the upper end of stake 11. Base 16 is a flat block of metal having a rectangular shape. A generally flat vertically disposed bar or stop member 17 is secured to the back of the upper end of stake 11 with welds or the like. The top horizontal edge of stop member 17 is located a short distance below base 16. A hinge 18 is attached to the back end of base 16. Hinge 18 pivotally connects a first generally upright member or plate 19 to base 16 with a generally horizontal pivot pin 21. Pin 21 and hinge 18 are located behind base 16 where they are protected from moving projectiles. A second member 22 or plate 22 is secured normal to the front of the lower end of first member 19. The rear end of member 22 is secured with welds to the lower end of member 19 adjacent hinge 18 to retain members 19 and 22 normal or 90 degress to each other. A downwardly extending arm 24 having counterweight 26 on its lower end is attached to the forward end of second member 22. Counterweight 26 is a transverse metal bar secured to the backside of the lower end of arm 26 whereby arm 24 projects the counterweight 26 from projectiles, such as bullets. First member 19 and arm 24 are generally parallel with arm 24 located forwardly of hinge 18. A silhouette 27 is connected to the forward side of member 19. Silhouette 27 is shown as an outline of a woodchuck. Silhouette 27 can have other configurations such as other small animals, birds, a human torso or a simulated concentric circle target design. Silhouette 27 is a hard steel plate that extends in an upright direction. Silhouette 27 is relatively narrow as compared to its height. There is only minimal side pressure on the hinge 18 when silhouette 27 is hit with a projectile. Silhouette 27 will flip over or pivot rearwardly when hit with a projectile as indicated by arrows 29 in FIGS. 1 and 4. The weight of member 27 is substantially less than the weight of counterweight 26 so that the target 10 is quickly reset. Triangular-shpaed wedge 23 is secured to the center of the bottom of silhouette 27 and to the second member 22 for additional support.

In use, stake 11 is inserted into the ground by applying a downward pressure on bar 13. Bar 13 can also be pushed into the ground thereby further anchoring target 10 to the ground. Counterweight 26 biases and holds the silhouette 27 in its generally upright position. Second member 22 is generally horizontal and in engagement with the top of base 16. Base 16 functions as a stop to yieldably hold silhouette 27 in its generally upright position. Counterweight 26 is engageable with the front of stake 11 so that stake 11 also functions as a stop to yieldably hold member 27 in the generally upright position.

Figure 4:
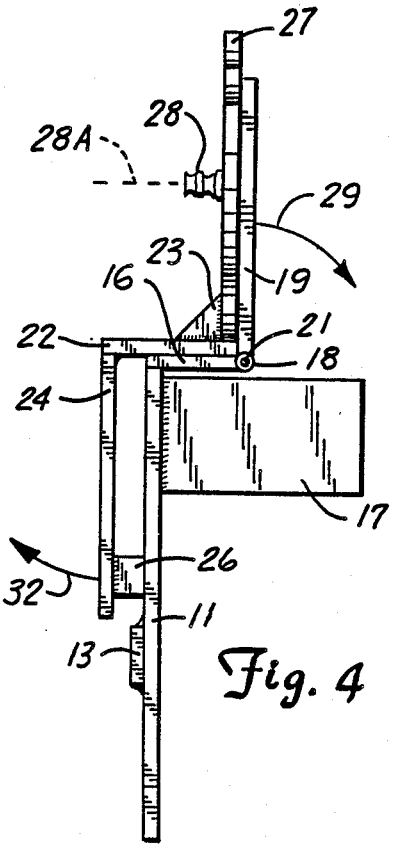
FIG. 4 is a side view of the target of FIG. 1 with the silhouette in the upright position.
Figure 5:
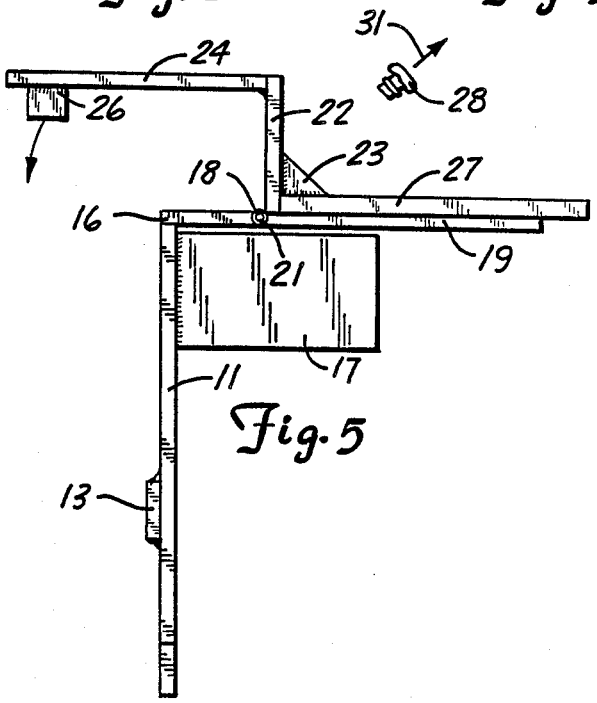
FIG. 5 is a side view of the target of FIG. 1 with the silhouette in the knock down position.

As shown in FIG. 4, when a projectile 28, such as a bullet moving along line 28A, strikes the silhouette 27, hinge 18 allows silhouette 27 to swing in a rearward direction as indicated by arrow 29. Projectile 28 deflects upwardly as indicated by arrow 31. This swings first member 19 downwardly and backward until it strikes the top of stop member 17. Second member 22 and arm 24 will be moved in a genrally upward direction as indicated by arrow 32. The movement of member 22 and arm 24 is against the biasing force of counterweight 26. When the impact force of projectile 28 is dissipated, countrweight 26 will automatically return member 19 and silhouette 27 to its upright position and hold silhouette in its upright position.

Target assembly 10 is usable for target practice and shooting competition with rifles and handguns. Preferably, rifles using .22 caliber long and .22 magnum ammunition and handguns using .22 caliber long to .44 caliber magnum ammunition do not destroy the target 10 including the silhouette 27.

While there has been shown and described a preferred embodiment of the invention, it is understood that changes in the structure, size of structure, materials, silhouette designs, and arrangement of the structure can be made by those skilled in the art without departing from the invention. The invention is defined in the following claims.

The embodiments of the invention in which an exclusive property or privilege is claimed are defined as follows:

1. A target assembly comprising: target means adapted to be hit with a movable projectile, said target means including a base, stake means secured to the base for anchoring the target means to a support, a movable member, hinge means connecting the movable member to the base for movement between a first generally upright position and a second rearwardly inclined generally horizontal position, silhouette means attached to the movable member, said movable member normally holding the silhouette means in a first generally upright position when said movable member is in its first position and in a second rearwardly inclined generally horizontal position when said movable member is in its second position, an arm attached to the movable member forward of the hinge means, said arm being projected in a downward direction when the movable member and silhouette means are in their first generally upright positions, and counterweight means connected to the arm to yieldably hold the movable member and silhouette means in their first generally upright positions, said counterweight means being engageable with the stake means when the arm is located in the downward direction, said counterweight means and hinge means allowing the silhouette means and movable member to move toward their rearwardly inclined second positions when hit with a moving projectile, said counterweight means moving the silhouette means and movable member to their first generally upright positions when the force of the projectile ont he silhouette means has been dissipated.

2. The assembly of claim 1 wherein: said base is a generally flat block, said stake means having an upper end, said block being secured to said upper end of the stake means.

3. The assembly of claim 1 including: a generally flat upright bar secured to the stake means, said bar projected rearwardly in a generally horizontal direction provides a stop for the movable member and silhouette means when moved to the second position.

4. A target assembly comprising: target means adapted to be hit with a movable projectile, said target means including a base, stake means secured to the base for anchoring the target means to a support, a movable member, hinge means connecting the movable member to the base for movement between a first generally upright position and a second rearwardly inclined genrally horizontaly position, silhouette means attached to the movable member, said movable member normally holding the silhouette means in a first generally upright position when said movable member is in its first position and in a second rearwardly inclined generally horizontal position when said movable member is in its second position, an arm attached to the movable member forward of the hinge means, said arm projected in a downward direction when the movable member and silhouette means are in their upright positions, a plate secured to the movable member projecting in forward generally horizontal direction when said movable member is in its first position and being engageable with the base when located in said horizontal direction, said arm being secured to said plate, and biasing means connected to the arm for biasing the movable member and silhouette means to their first generally upright positions, said biasing means and hinge means allowing the silhouette means and movable member to move toward their rearwardly inclined second positions when hit with a moving projectile, said biasing means moving the silhouette means and movable member back to their first generally upright postions when the force of the projectile on the silhouette means has been dissipated.

5. The assembly of claim 4 wherein: said biasing means includes counterweight means attached to the arm to yieldably hold the movable member and silhouette means in their generally upright positions.

6. The assembly of claim 4 wherein: said hinge means is secured to said base to normally position the movable member in its generally upright position and said plate in a generally horizontal position, said plate being engageable with said base to locate said movable member and silhouette means in their generally upright positions.

7. The assembly of claim 4 including: a bar secured to the stake means, said bar projected rearwardly in a generally horizontal direction providing a stop for the movable member and silhouette means when moved to their second positions, said arm projected in a downward direction when the movable member and silhouette means are in their upright positions, and said biasing means comprising counterweight means engageable with said stake means when said arm is located in said downward direction, said counterweight means yieldably holding said arm in said downward direction.

8. The assembly of claim 4 including: a generally flat vertical bar secured to the stake means and extended in a rearward generally horizontal direction from said base.

9. The assembly of claim 4 including: a transverse bar secured to the stake means adjacent the lower end thereof.

10. A target assembly comprising: target means adapted to be hit with a movable projectile, said target means including a generally horizontal base having upper and lower surfaces, a stake having an upper end secured to the lower surface of the base adapted to be anchored to a support, a bar secured to an upper portion of the stake extended generally horizontal in a rearward direction from the stake, silhouette means providing a target adapted to be hit with a moving projectile, movable means for supporting the silhouette means in a genèrally upright first position and allowing the silhouette means to move when hit with aa projectile to a rearwardly inclined second position, a hinge pivotally connecting the base to said movable means to allow said silhouette means to move between said first and second positions, said movable means including a plate extended in a forward direction and engageable with the base to hold the silhouette means in its upright position, a downwardly extended arm connected to the plate forwardly of the hinge and biasing means connected to said arm to yieldably hold said arm in a downward direction and said silhouette means in its first position, said silhouette means when hit with a projectile being pioted from the first position in a rearward direction toward said second position, said biasing means pivoting the silhouette means back to the upright position when the force of the projectile on the silhouette means has been dissipated.

11. The target assembly of claim 10 wherein: said stake provides a stop engageable by the biasing means connected to said arm when the silhouette means is located in the upright first position.

12. The target assembly of claim 10 wherein: said biasing means includes a counterweight attached to lower end portion of the arm to yieldably hold the silhouette means in a generally upright first position.

13. The assembly of claim 12 wherein: the counterweight is engageable with the stake whereby the stake provides a stop for the arm when located in the downward direction.

14. The assembly of claim 10 including: a transverse bar connected to a lower portion of the stake.

15. A target assembly comprising: target means adapted to be hit with a moving projectile, said target means including first means for anchoring the target means to a support, a movable member, second means connecting the movable member to the first means for movement between a first generally upright position and a second generally non-upright position, silhouette means attached to said movable member, said movable member normally holding the silhouette means in the generally upright position when said movable member is in its first position and in a second generally non-upright position when said movable member is in its second position, a plate connected to the movable member, and a downwardly extending arm connected to the plate and a counterweight attached to a lower part of the arm for biasing the movable member and silhoutte means to their normally upright positions and allowing said silhouette means and movable member to move to their non-upright positions when the silhouette means is hit with a projectile, said counterweight moving said silhouette means and movable membr back to their upright positions when the force of the projectile on the silhouette means has been dissipated.

16. The assembly of claim 15 wherein: said first means includes a base and stake means secured to the base for anchoring the target means to a support.

17. The assembly of claim 15 wherein: said second means comprises a hinge pivotally mounting the movable member to the first means for movement between its first generally upright position and its second generally non-upright position.

18. The assembly of claim 15 wherein: said first means includes a downwardly extending stake and said counterweight being engageable with the stake when the movable member and silhouette means are in their generally upright positions.

19. The assembly of claim 15 wherein: the counterweight is engageable with the first means whereby the first means provides a stop for the arm when located in a generally downward direction.

20. The assembly of claim 15 including: generally flat bar means secured to the first means, said bar means projected rearwardly in a generally horizontal direction providing a stop for the movable member and silhouette means when moved to their non-uprght positions.

* * * * *